US005746193A

United States Patent [19]

Swan

[11] Patent Number: 5,746,193

[45] Date of Patent: May 5, 1998

[54] PRESS ASSEMBLY FOR A PORTABLE MASONRY CUT-OFF SAW

[75] Inventor: Leo Swan, Jefferson, Md.

[73] Assignee: Equipment Development Company, Inc., Frederick, Md.

[21] Appl. No.: 832,558

[22] Filed: Apr. 2, 1997

[51] Int. Cl.[6] ..... B28D 1/04

[52] U.S. Cl. ..... 125/13.03; 451/361; 144/286.5; 83/574

[58] Field of Search ..... 125/13.03, 14, 125/16.03, 17, 35; 451/360, 361; 144/286.5; 83/574, 169

[56] References Cited

U.S. PATENT DOCUMENTS

| | | | |
|---|---|---|---|
| 1,552,340 | 9/1925 | Paul | 144/286.5 |
| 2,726,651 | 12/1955 | Tucker | 125/13.03 |
| 2,998,812 | 9/1961 | Cooper | 125/13.03 |
| 3,621,829 | 11/1971 | Maluck | 125/13.03 |
| 3,807,095 | 4/1974 | Harding et al. | 125/13.03 |
| 4,055,160 | 10/1977 | Wilson | 125/13.03 |
| 4,351,209 | 9/1982 | Alford | 83/574 |
| 4,428,159 | 1/1984 | Sigetich et al. | 125/13.03 |
| 4,446,845 | 5/1984 | Harding | 125/13.03 |
| 4,807,506 | 2/1989 | Audet | 83/574 |
| 5,127,391 | 7/1992 | O'Keefe | 451/360 |
| 5,135,287 | 8/1992 | Karnes | 125/13.03 |
| 5,172,680 | 12/1992 | Swan | 125/13.03 |
| 5,592,981 | 1/1997 | Derecktor | 144/286.5 |

FOREIGN PATENT DOCUMENTS

| | | | |
|---|---|---|---|
| 2197818 | 6/1988 | United Kingdom | 144/286.5 |

*Primary Examiner*—James G. Smith
*Assistant Examiner*—Derris H. Banks

[57] ABSTRACT

An assembly in the form of a press for holding a conventional hand-held portable gasoline engine powered masonry cut-off saw. The assembly includes a vertical frame secured to a pan and on which the cut-off saw is pivotally mounted. The frame is detachable for ease of transport and shipment. A gas bias spring acts to normally position the cut-off saw up and away from a movable work table positioned on the pan. A support plate affixed to a pivot shafted mounted on the frame includes means at both ends for positioning and firmly holding the saw in place during a cutting operation. The speed and on-off control of the saw is provided by a twist hand grip throttle mounted on the outer end of an operator actuated lever arm secured to the pivot shaft. The twist grip throttle is coupled by means of a cable to a trigger actuable blade speed control assembly mounted on the hand grip at the rear end of the cut-off saw.

25 Claims, 7 Drawing Sheets

PRESS ASSEMBLY FOR A PORTABLE MASONRY CUT-OFF SAW

BACKGROUND OF THE INVENTION

1. Field of the Invention

The present invention relates generally to masonry saws for cutting concrete blocks, bricks, marble, tile, stone and other objects, and more particularly to a press assembly for holding a normally hand-held gasoline engine powered masonry cut-off saw during a cutting operation.

2. Description of the Prior Art

Masonry saws driven by electric motors and gasoline engines are generally known. However, masonry saws which are powered by an electric motor have an inherent number of limitations. For example, if an individual is working at a cite which is not serviced by electricity, it is extremely inconvenient or impossible to operate the saw. Furthermore, where a masonry saw is "wet-cutting" a workpiece, a great danger exists unless proper safety measures are taken to ensure safety of the operator.

This led to the development of a gasoline driven masonry saw apparatus as shown and described in U.S. Pat. No. 4,446,845, entitled, "Self-Contained Gasoline Driven Portable Masonry Saw", issued to Edward M. Harding on May 8, 1984 and assigned to the present assignee. The invention described therein is directed to a portable-table type masonry saw for cutting concrete blocks, bricks, etc., including a gasoline engine for driving a saw blade through a belt drive arrangement coupled to an arbor shaft on which a cutting blade rotates. The gasoline engine is mounted on a stationary support and is kept stationary while the saw blade is pivotally mounted by means of a pivot shaft for engagement and disengagement with the workpiece. A water tray and pump are provided for wet-cutting. The water pump, moreover, is connected to an output shaft of the gasoline engine through a drive belt which may be removed to permit dry cutting operations.

SUMMARY

Accordingly, it is an object of the present invention to provide an improvement in gasoline-powered masonry saws which are used for cutting concrete blocks, bricks, tile, stone and other material.

It is another object of the present invention to provide an improved masonry saw assembly for accommodating a conventional hand-held and portable gasoline engine powered masonry cut-off saw.

It is a further object of the invention to provide a press assembly on which a conventional hand-held gasoline engine powered masonry cut-off saw is removably mounted.

These and other objects are achieved by a masonry cut-off saw press assembly for accommodating a conventional hand-held gasoline engine powered masonry cut-off saw. The assembly comprises, among other things, a pivot shaft mounted on a frame including a pair of vertical posts secured to a generally rectangular water tray or pan which can be supported, when desirable, by a folding stand. The vertical posts are detachable for ease of transport and shipment of the assembly. A support base in the form of an elongated plate is transversely connected to the pivot shaft and includes means for gripping and holding the saw firmly in place when positioned thereon and further includes means for engaging front and rear carrying handles of the cut- off saw. A gas spring connected between the saw support plate and the frame acts to bias the cut-off saw up and away from a rolling type work table located on and supported by the water tray. The speed and on-off control of the saw blade is transferred to a lever arm also connected to the pivot shaft by a twist type hand grip controller mounted on the end of the lever arm. The controller is coupled via a cable to an actuator assembly mounted on the hand grip at the rear of the cut-off saw, with the actuator assembly including a pivot arm secured to a fixture straddling the hand grip and being engageable with a trigger type throttle of the cut-off saw. Additionally, a member held in place by the fixture fits over the hand grip to actuate a saw enabling switch of the saw.

Other objects and further scope of applicability of the present invention will become apparent from the detailed description provided hereinafter. It should be understood, however, that the detailed description and specific example, while indicating the preferred embodiment of the invention, is given by way of illustration only, since various changes within the spirit and scope of the invention will become apparent to those skilled in the art from this detailed description.

BRIEF DESCRIPTION OF THE DRAWINGS

The present invention will be more readily understood when considered in conjunction with the accompanying drawings which are provided by way of illustration only, and thus are not meant to be limitative of the invention, and wherein.

DETAILED DESCRIPTION OF THE INVENTION

Figure 1:
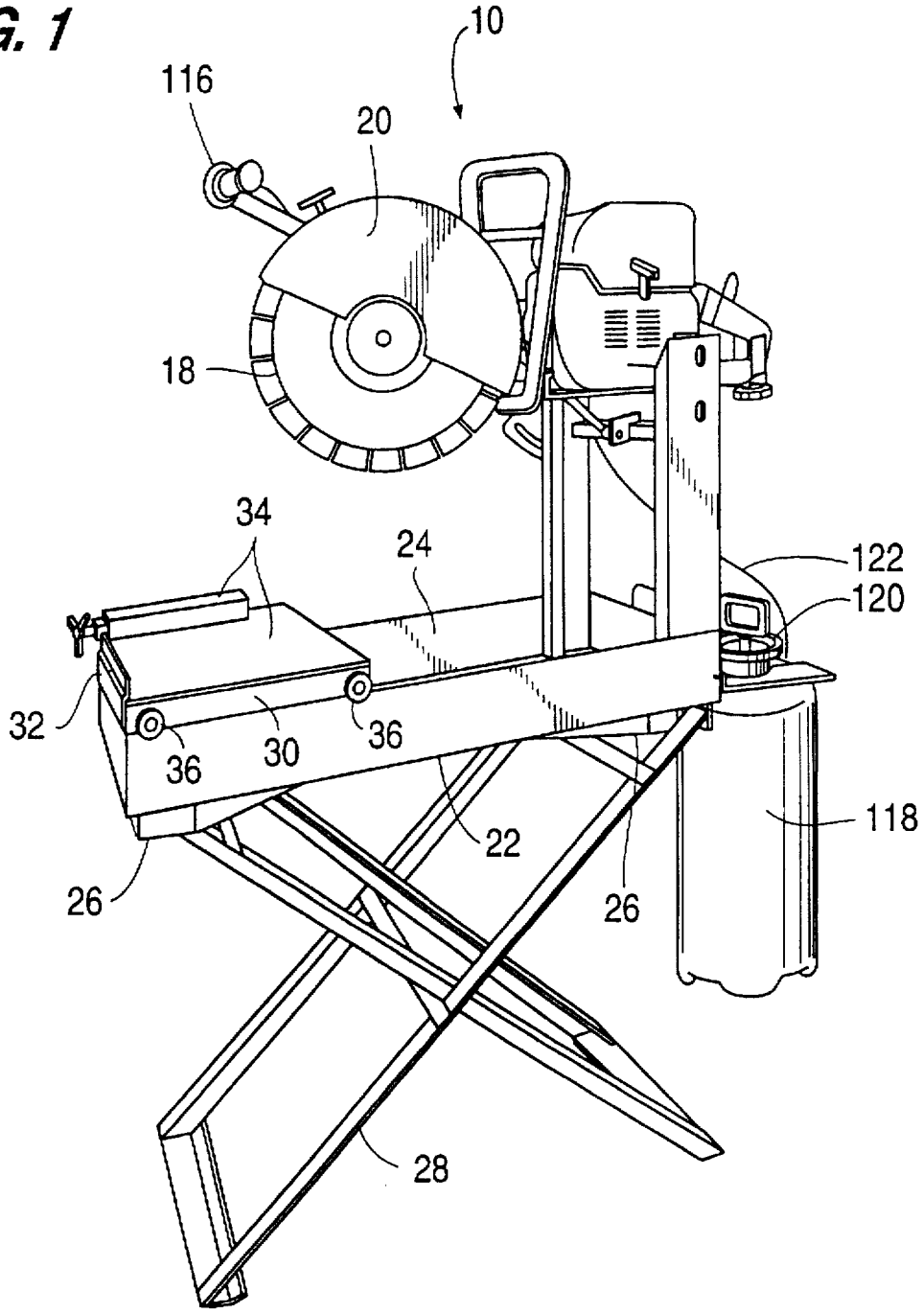
FIG. 1 is a perspective view generally illustrative of the preferred embodiment of the invention.
Figure 2:
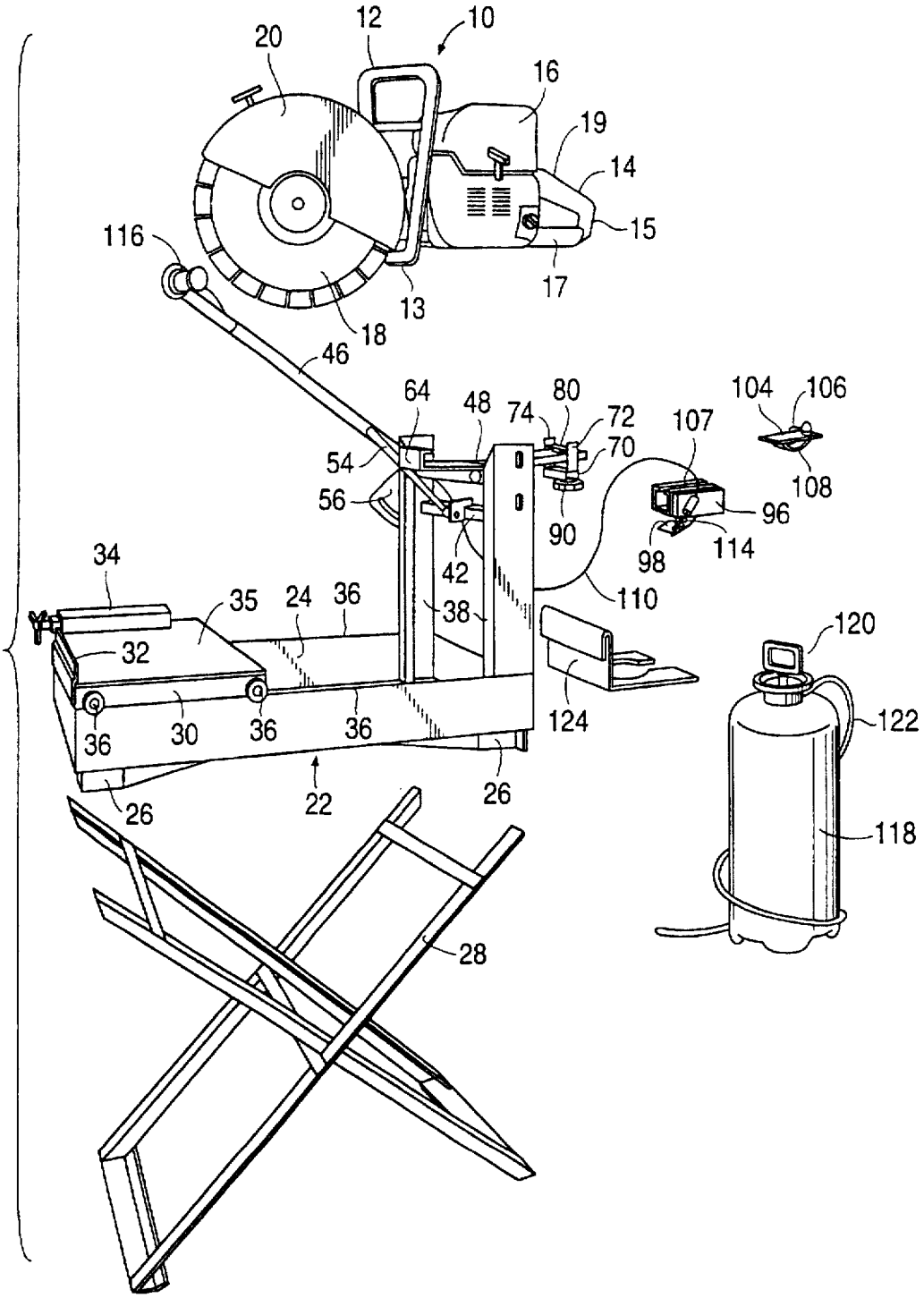
FIG. 2 is an exploded perspective view of the embodiment of the invention shown in FIG. 1.

Referring now to the drawings wherein like reference numerals refer to like parts throughout, reference numeral 10 as shown in FIGS. 1 and 2, denotes a conventional hand-held masonry cut-off saw powered by an internal combustion engine and having front and rear carrying handles 12 and 14, with the rear handle 14 also including a manually activated safety switch for enabling blade rotation and a trigger type blade speed control throttle, not shown. Between the carrying handles 12 and 14, is located a gasoline engine 16 which is coupled to and drives a circular masonry saw blade 18, partially covered by a blade cover 20. This type of apparatus is manufactured and sold by many different manufacturers, and comes in various shapes and designs, but nevertheless includes the essential elements referred to in the industry as a hand-held masonry cut-off saw.

The present invention has been developed for providing a press whereby an off-the-shelf masonry cut-off saw 10 can be used in a table-type saw configuration without any modification whatsoever.

Figure 3:
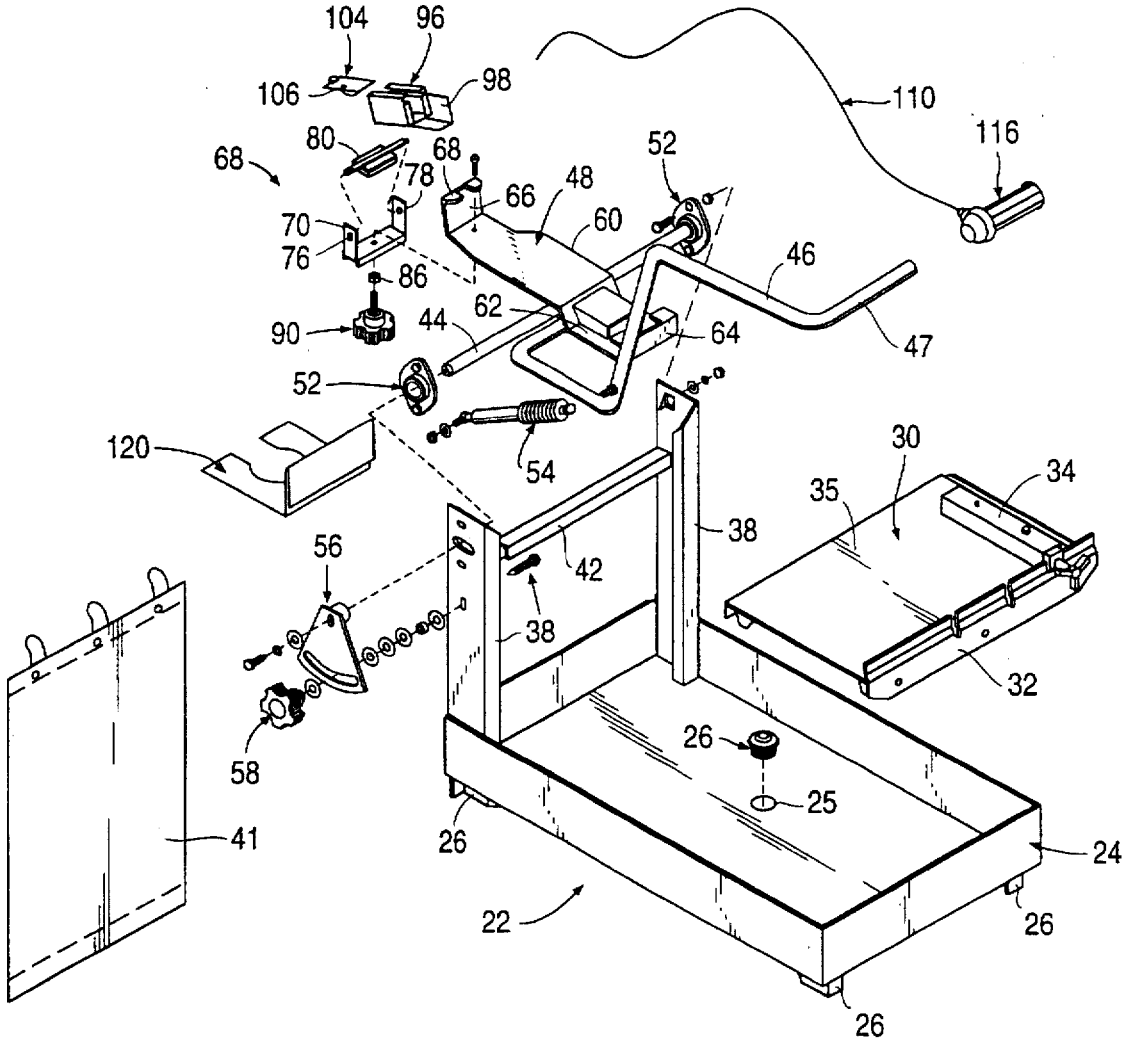
FIG. 3 is an exploded view further illustrative of the invention shown in FIG. 1.

Accordingly, a press assembly is shown in the drawings including a base 22, consisting of a rectangular catch tray such as a water pan 24 having a drain hole 25 and a stopper 26 (FIG. 3). A short leg assembly 27 located on the underside of the tray 24 is adapted to rest on a solid bench top, not shown, or when desirable, can be used with a folding stand 28, as shown in FIG. 1.

Additionally, a rolling workpiece table 30 having an end wall 32, a guide member 34 and a flat work support plate 35. A set of wheels 36 permits the table 30 to rest upon the tray 24 so that it can move back and forth along the top edges of the tray 24. This type of structure is well known, having been shown and described in an aforementioned U.S. Pat. No. 4,446,845.

This now leads to a consideration of the structural details for holding and controlling an off-the-shelf cut-off saw, whereby a user can cut concrete blocks, bricks, marble, tile, stone and other objects.

Figure 4:
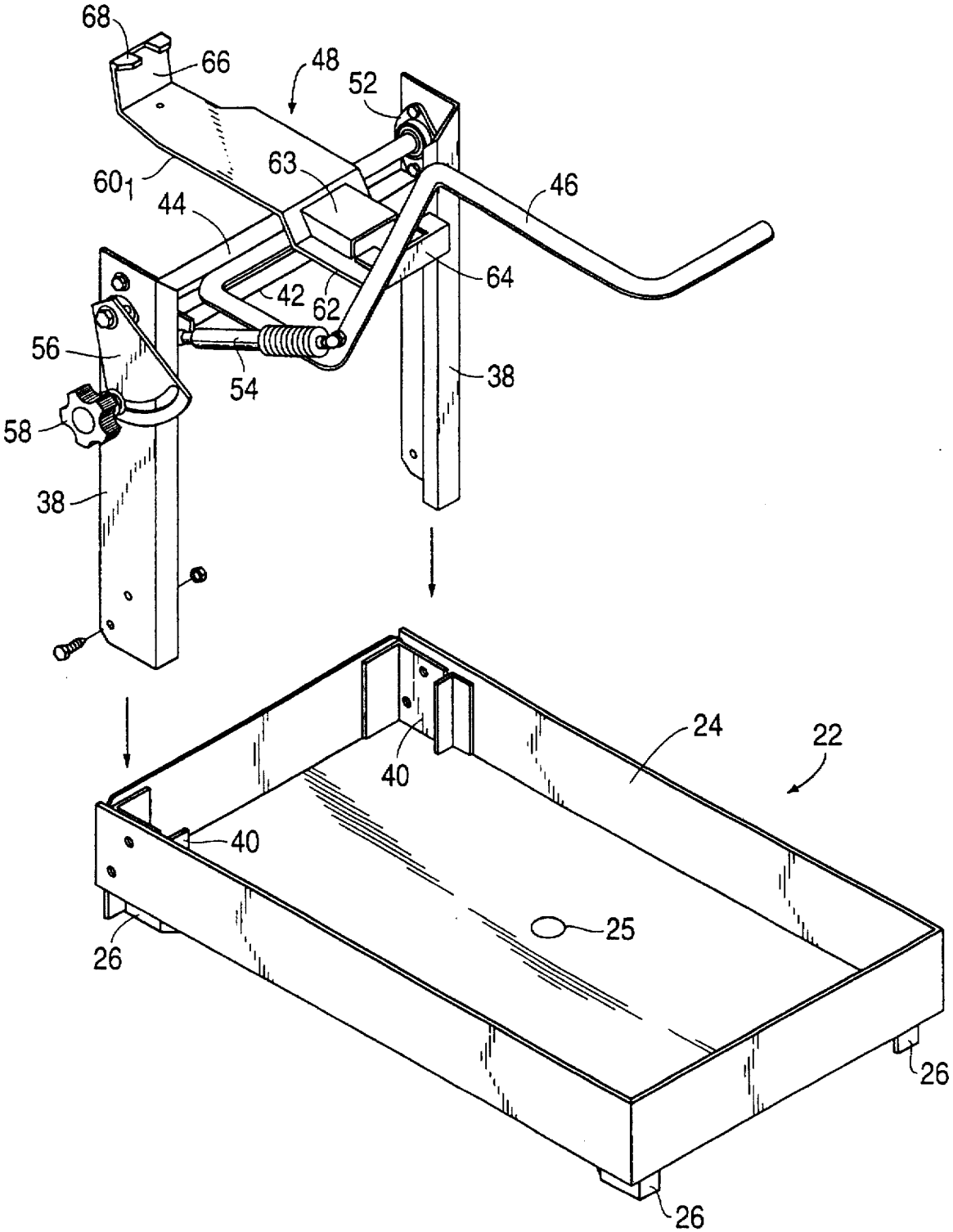
FIG. 4 is a perspective view illustrative of the parts shown in FIG. 3 when assembled.
Figures 5A, 5B, 5C, 5D:
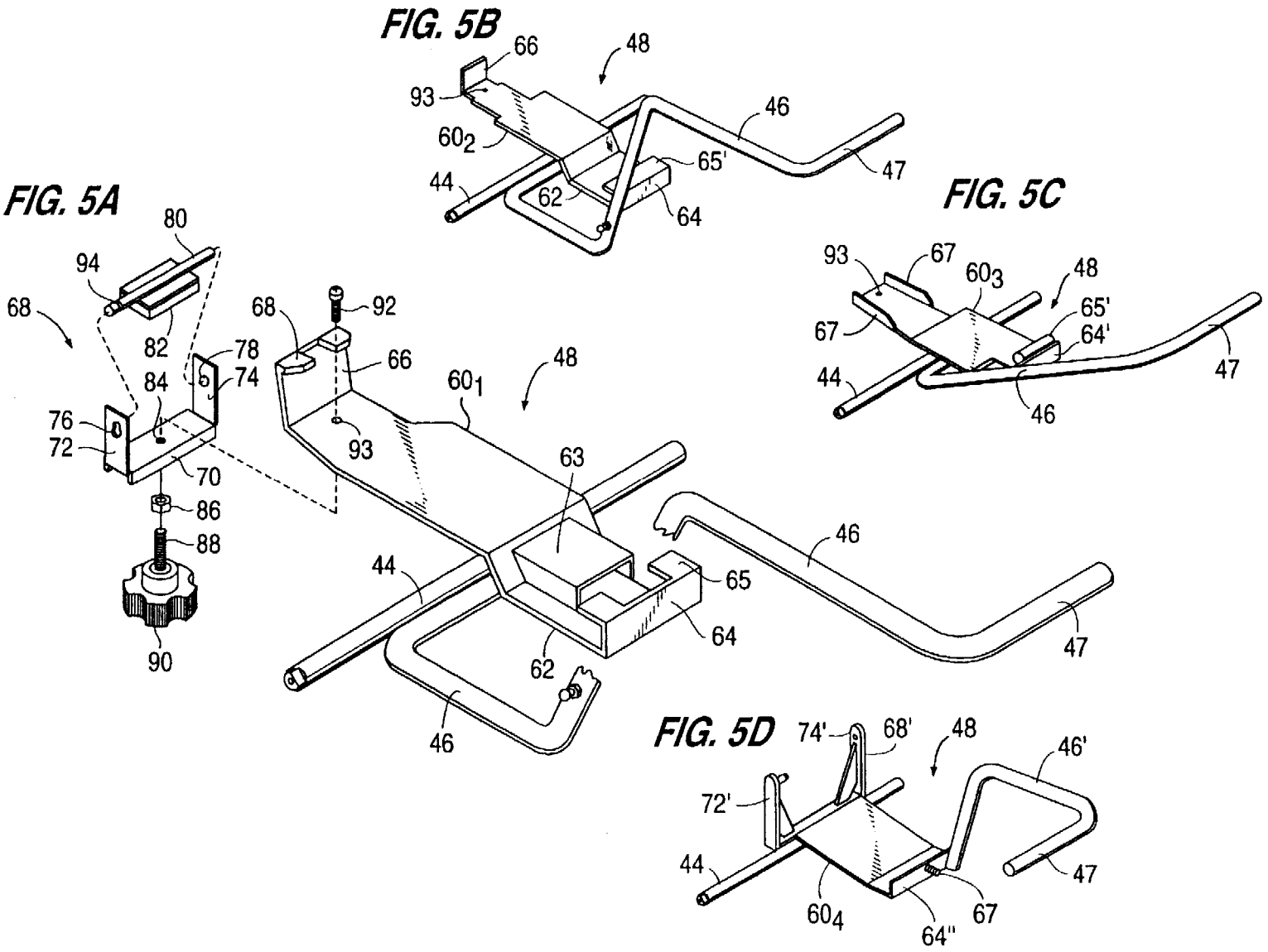
FIG. 5A is a partial exploded view of one embodiment of a support assembly for holding a hand-held gasoline engine powered masonry cut-off saw.
FIGS. 5B–5D are perspective views of other types of support assembly for holding a masonry cut-off saw.

To this end, and as shown in FIG. 4, the assembly includes a vertical support frame comprised of a pair of detachable vertical upright channel members 38 which are attached to a pair of side wall brackets 40 located at the rear of the tray 24. A crossbar member 42 straddles the upper portion of the uprights 38 and is adapted to, among other things, act as a curtain rod for a splash curtain 41. Above the crossbar member 42 is a pivot shaft 44 to which is bonded an angulated lever arm 46 and a transversely oriented saw support assembly 48 for supporting the cut-off saw 10 when positioned thereon. While one embodiment of the saw support assembly 48 and lever arm 46 is shown in FIG. 4 as well as FIG. 5A, these other embodiments thereof are illustrated in FIGS. 5B–5D and will be described hereinafter. The pivot shaft 44, moreover, is mounted in a pair of ball bearing assemblies 52 secured by suitable hardware to the top outer portion of the uprights 38. A compression type gas spring 54 is attached at one end to the crossbar member 42 and at the other end to the lever arm 46 as best shown in FIG. 4, so that when the lever arm 46 is manually pulled down during a cutting operation, it will return to a rest position as shown when downward pressure is removed from the lever arm 46.

A fixed cutting position of the saw 10 when mounted on the support assembly 48 can be achieved by an arcuately slotted generally triangular plate 56 pivotally attached to one upright 38 and a hold-down knob 58 which includes a threaded shank, not shown. This enables a fixed depth cut to be made on a workpiece placed on the table 30.

Turning now to the details of the saw support assembly 48, it comprises a plate which is adapted to accommodate and hold a particular manufacturer's design of a masonry cut-off saw and thus is tailored to meet the specific requirements of the saw with which it is used.

As shown in the embodiment of FIG. 5A, the saw support assembly comprises an elongated metal plate $\mathbf{60_1}$ having a step-down front portion 62 including a protrusion 63 which terminates in an open channel section 64 having a folded back bifurcated lip 65. The rear end of the plate $\mathbf{60_1}$ includes an upturned tail portion 66 which also includes a folded back bifurcated lip 68. The front channel section 64 is adapted to receive the bottom cross bar element 13 of the front carrying handle 12 of the cut-off saw 10 shown in FIG. 2, while the rear tail piece 66 is adapted to receive and position the rear upturned portion 15 of the rear carrying handle 14 shown in FIG. 2.

The embodiment of the saw support assembly 48 shown in FIG. 5B comprises a modified plate $\mathbf{60_2}$ also having a step-down front portion 63, however, it terminates in an upturned channel section 64 having a simple folded back lip 65'. The protrusion 63 is eliminated, thereby providing a wider opening for receiving the front carrying handle 12. The rear end of the plate $\mathbf{60_2}$ also now narrows back to an upturned tail portion 66 but which is now devoid of a bifurcated lip 68 shown in FIG. 5A.

With respect to the embodiment depicted in FIG. 5C, the saw support assembly comprises a plate member $\mathbf{60_3}$ which lacks the step-down front portion 62 of the plates $\mathbf{60_1}$ and $\mathbf{60_2}$. The front portion 62' now includes an upturned end section 64' to which is attached a cylindrical piece 65' of metal having a relatively small diameter so that the front part of the front carrying handle fits beneath it. The rear end of the plate $\mathbf{60_3}$ now eliminates the upturned tail portion 66 shown in FIGS. 5A and 5B in favor of a pair of upturned side wings 67. Also the lever arm 46 eliminates the intermediate bend in its length, also shown in FIGS. 5A and 5B.

Before considering the embodiment of FIG. 5D, it should be noted that the support assemblies 48 of the embodiments shown in FIGS. 5A, 5B and 5C also operate in conjunction with a retaining yoke assembly 68 (FIG. 5A) which is located at the rear end of the respective plates $\mathbf{60_1}$, $\mathbf{60_2}$ and $\mathbf{60_3}$ for engaging and firmly holding the rear handle 14 of the saw 10 on the support assembly 48 when the front handlebar portion 13 engages the front section of the plates.

Figure 6:
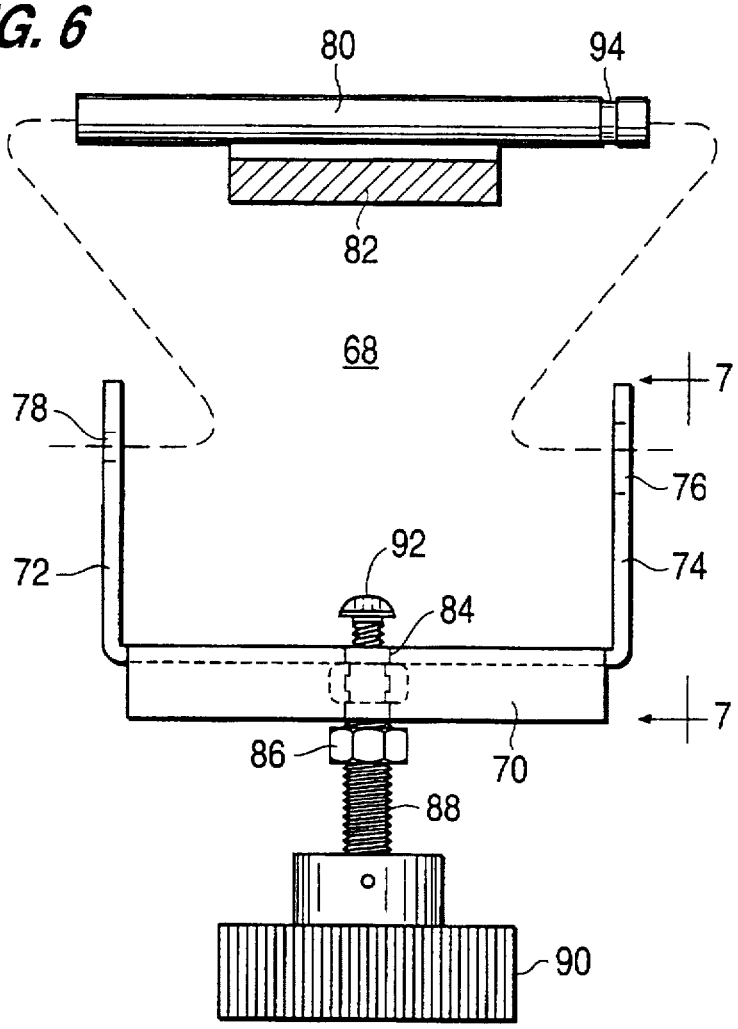
FIG. 6 is a front elevational view of a yoke assembly located at the far end of the support for holding a masonry cut-off saw in place.
Figure 7:
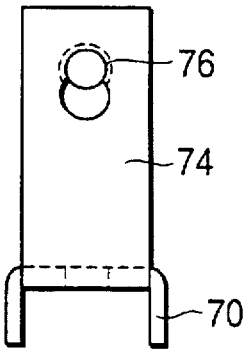
FIG. 7 is a side elevational view of one element of the retaining yoke assembly shown in FIG. 6.

As further shown in FIGS. 6 and 7, the yoke assembly 68 includes a U-shaped bracket 70, a pair of upturned arms 72 and 74 containing apertures or holes 76 and 78 for receiving the end portions of a retaining pin 80 which also includes a resilient pressure pad 82 secured thereto for contacting the holding down the lower horizontal section 17 of the carrying handle 14. The bracket 70 additionally includes a through hole 84 and a captured nut 86 through which is adapted to pass a threaded shank 88 of a knob 90. The threaded shank 88 is adapted to receive a threaded bolt 92 passing through hole 93 in the plate $\mathbf{60_1}$ in order to generate a pull-down action on the pin 80 across the top of the lower handle section 17 of the rear handle 14, and which will lock and firmly hold the cut-off saw 10 firmly in place on the support plate 60. For ease of insertion and locking of the pin 80 in the yoke 70, the hole 76 is made oblong as shown in FIG. 7 and is adapted to engage a groove 92 formed at one end of the locking pin 80 as shown in FIG. 6.

Returning now to FIG. 5D, shown thereat is a saw support assembly 48 comprised of a relatively short metal plate $\mathbf{60_4}$ attached to the pivot shaft 44 at the rear wherein there is also included a modified yoke assembly 68' including a pair of upturned arms 72' and 74' including means for engaging a retaining pin, not shown. The front part of the plate $\mathbf{60_4}$ includes an upturned edge section 64" which also includes a lock screw for engaging the front part of a particular type of masonry saw. Also a modified linear arm 46' is now attached to the edge member 64" rather than the pivot shaft 44.

Figure 8:
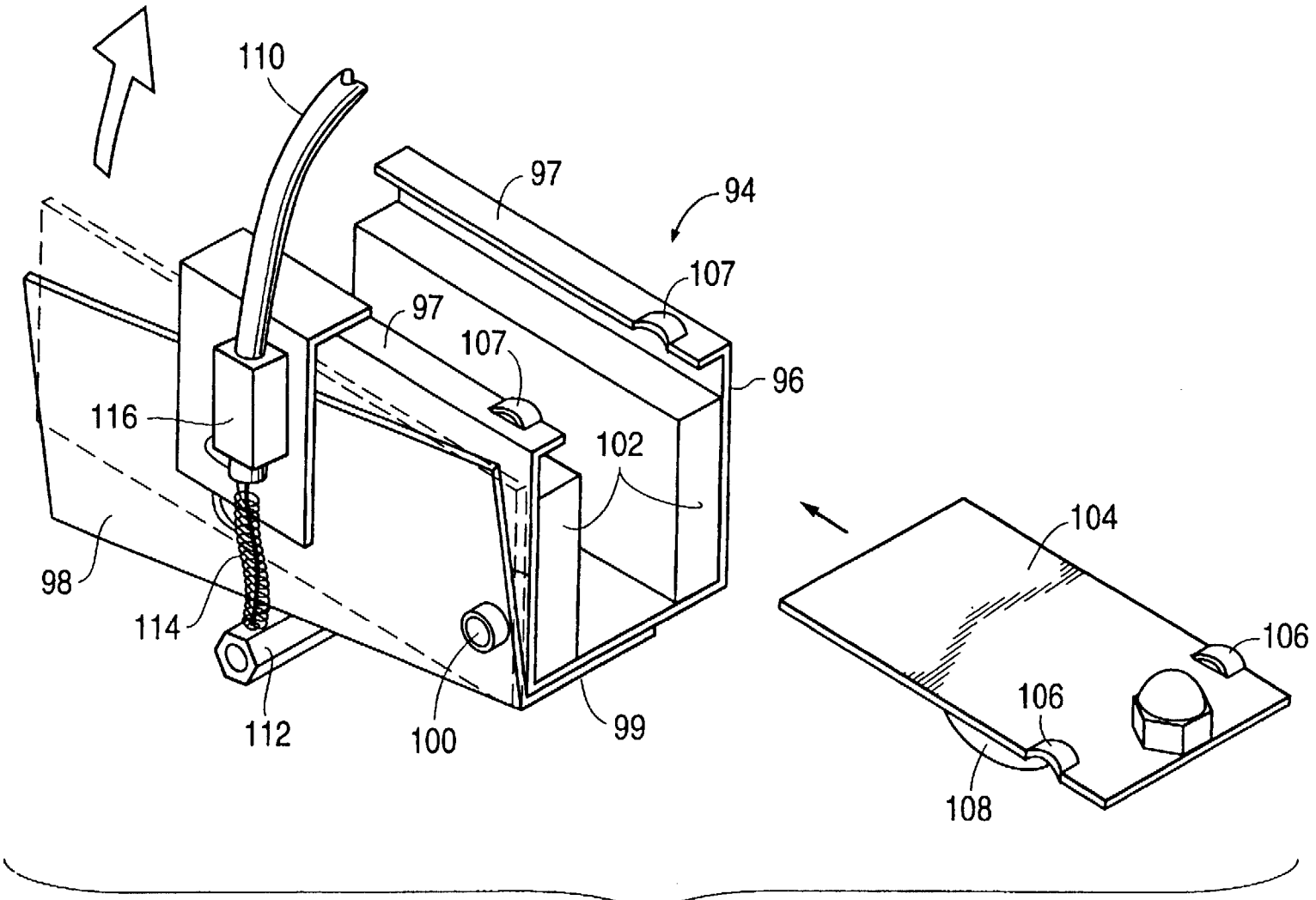
FIG. 8 is a perspective view illustrative of the throttle actuator assembly attached to the hand grip at the rear of the cut-off saw when located on the cut-off saw as shown in FIG. 1.

In order to control the rotary speed of masonry saw blade 18, the present invention also includes an assembly 94 for controlling a trigger type throttle and an emergency cut-off switch located on the upper hand grip portion 19 of the rear handle member 14. The details of the assembly 94 is shown in FIG. 8 and comprises a three sided box-like frame 96 on which an L-shaped plate 98 is pivotally attached at the pivot point 100. Also, a pair of relatively soft rubber pads 102 line the side walls of the fixture 96 so as to contact the side portions of the hand grip portion 19 of the rear handle 14. The L-shaped member 98 extends beyond the length of the frame 96 so that the lower flat side portion 99 thereof can contact and actuate the speed trigger, not shown, on the underside of the hand grip 19 of the saw 10.

Also shown in FIG. 8 is a retaining spring plate 104 having a pair of raised detent type elements 106 which are adapted to engage a pair of complementary receptor elements 107 located in the top shoulder segments 97 of the fixture 96 when slide into place over the upper side edges of the pads 102 to contact and depress a saw enabling switch located on the upper portion of the hand grip 19. Thus when locked into position, a leaf spring 108 on the underside of the plate 106 depresses the trigger release safety lever switch, sometimes referred to as a "dead man" switch, so that actuation of the saw's throttle can be carried out remotely from the saw itself.

Accordingly, actuation of the pivoted plate 98 on the fixture 96 is achieved via a throttle control cable 110, having one end attached to a bar 112, passing under the L-shaped plate 98 with a bias compression spring 114 being located between the bar 112 and a block termination 116. The other end of the cable 110 is connected to a twist hand grip type throttle controller 116 which is located on the end portion 47 of the operator actuator lever arm 46 as shown in FIG. 2. Actuation of the twist grip controller 116 causes the pivoted plate 98 to pull up against the trigger of the saw 10 so as to control the speed of the saw blade 18.

Also shown, for examples in FIGS. 1 and 2, is a water tank 118 including a pump mechanism 120 which is adapted to feed water to cutting blade cover 20 via a hose 122. The water tank 18 is adapted to fit on a right angled bracket member 120.

Thus, when one wishes to mount the hand transportable masonry cut-off saw 10 on the saw support assembly 48 such as shown in FIG. 5A for a fixed use operation, one would slide the lower section 13 of the front handle 12 into the front end of the assembly and then lower the saw 10 onto the, so that the lower portion 17 of the rear handle 14 rests, for example, between the uprights 72 and 74 of the retaining yoke 70. The rear handle 14 is next pushed firmly downward and the pin 80 is inserted through the holes 76 and 78 in the retaining yoke 70. The body of the saw 10 is now firmly held in place. This is followed by turning of the knob 90, pulling the saw tightly against the saw support base plate 60. Similar procedures would be followed for the embodiment shown in FIGS. 5B, 5C and 5D.

Next, the trigger actuating control mechanism 94 shown in FIG. 8 including the frame 96 and the retaining spring plate 104, is mounted on the upper portion 19 of the rear handle 14 with the normally finger actuated trigger of the saw being seated on the lower portion 99 of the trigger plate 98 so that the trigger is free to move when the twist group throttle control 116 is activated. Next the spring plate 104 is slid into place on the frame 96 until the detent elements 106 and 107 become engaged. The trigger release safety lever of the saw will now be retained in the depressed position by virtue of the leaf spring 108 bearing down upon it. Thus when the operator turns the hand grip 116, the speed of the cutting blade 18 will increase or decrease.

Next a loosening of the knob 58 on a side of the upright 38 shown in FIG. 4 permits the operator to lower the blade 18 onto a workpiece located on the table 30 by pulling down on the lever arm 46. When the cut is made, a release of the hand grip will cause the blade 18 to return to a next position by virtue of the gas spring 54. The blade 18 can be lowered and caused to remain at a selected fixed position by tightening of the knob 58. With such a setting, a workpiece on the table 30 can be held with both hands and pushed into the blade 18.

When a wet cutting operation is needed, water can be fed from the water tank 18 to the plate cover 19, where it will then fall into the tray 24, where it can be emptied by virtue of the stopper 29 (FIG. 3) being removed from the drain hole 27.

Thus what has been shown and described is a masonry saw assembly which permits one of any number of presently commercially available hand transportable masonry cut-off saws to be mounted on and removed from the same table type cutting assembly.

Having shown and described what is at present considered to be the preferred embodiment of the invention, it should be noted that the same has been made by way of illustration and not limitation. Accordingly, all modifications, alterations and changes coming within the spirit and scope of the invention are herein meant to be included.

I claim:

1. A press assembly for a portable masonry cut-off saw, comprising:

a base including a frame having a pair of mutually parallel upright leg members;

a pivot shaft mounted between the upright leg members;

a cut-off saw support assembly for supporting a hand-held portable masonry cut-off saw including an internal combustion engine, an engine driven rotary saw blade, and front and rear carrying handles;

said saw support assembly further including a mounting plate, first means located at one end of said mounting plate for engaging and securing said front carrying handle of the cut-off saw and second means located at the other end of said mounting plate for engaging and securing said rear carrying handle of the cut-off saw;

a lever arm for pivotally lowering and raising a cut-off saw mounted on said support assembly to and from a workpiece; and engine throttle control means for controlling rotary operation of the saw blade, said throttle control means including a hand actuable controller located on the lever arm and an actuator assembly attached to said rear carrying handle, said actuator assembly being coupled to said hand actuable controller for actuating a throttle member of the saw in response to operation of said controller.

2. An assembly in accordance with claim 1 wherein said mounting plate is affixed to said pivot shaft.

3. An assembly in accordance with claim 2 wherein said first means for engaging the front carrying handle includes an upturned front end portion of the mounting plate.

4. An assembly in accordance with claim 3 wherein said front end portion includes a step-down plate section forward of said pivot shaft.

5. An assembly in accordance with claim 3 wherein said upturned front end portion includes a top lip folded back toward said pivot shaft.

6. An assembly in accordance with claim 5 wherein said top lip is bifurcated.

7. An assembly in accordance with claim 3 wherein said upturned front end portion includes a flat section of the support plate.

8. An assembly in accordance with claim 7 wherein said front end portion also includes a member secured to the top of said flat section so as to allow said front carrying handle to fit thereunder.

9. An assembly in accordance with claim 2 wherein said second means for engaging the rear carrying handle includes an upturned tail portion at the rear of the support plate.

10. An assembly in accordance with claim 9 wherein said upturned tail end portion includes a top lip folded back toward said pivot shaft.

11. An assembly in accordance with claim 10 wherein said top lip is bifurcated.

12. An assembly in accordance with claim 10 and additionally including a retaining yoke assembly attached to a rear portion of the support plate for holding said rear carrying handle securely in place on the support plate.

13. An assembly in accordance with claim 12 wherein said yoke assembly includes a U-shaped bracket including a pair of upturned arm members adapted to straddle said rear carrying handle of the saw when positioned on said support plate and having mutually opposing pin receiving holes formed in the outer end portions thereof, and an elongated holding pin adapted to be placed over a lower handle section of said rear carrying handle and engage arm members by being inserted in said receiving holes thereof.

14. An assembly in accordance with claim 13 wherein said yoke assembly additionally includes a rotatable knob having a threaded shank for engaging a bolt passing through said support plate and said bracket and operating as a pull-down assembly for the rear carrying handle when in position over the lower handle section of said rear carrying handle.

15. An assembly in accordance with claim 9 wherein said upturned tail portion includes a flat section of the support plate.

16. An assembly in accordance with claim 2 wherein said second means for engaging the rear carrying handle includes a pair of upturned side wings of said mounting plate located behind said pivot shaft.

17. An assembly in accordance with claim 2 wherein said second means for engaging the rear carrying handle includes a pair of upturned arms secured to said mounting plate adjacent said pivot shaft.

18. An assembly in accordance with claim 1 wherein said actuator assembly of said throttle control means comprises a trigger actuating assembly for depressing and actuating a trigger type throttle mechanism located in said rear carrying handle of the saw.

19. An assembly in accordance with claim 18 wherein said trigger actuating assembly includes an actuator member pivotally attached to a box-like frame contacting side portions of said rear carrying handle in relatively close proximity to said throttle mechanism.

20. An assembly in accordance with claim 19 wherein said hand actuable controller located on the lever arm comprises a twist type hand grip controller.

21. An assembly in accordance with claim 20 and wherein said actuator member is coupled to said controller by means of a cable assembly.

22. An assembly in accordance with claim 1, wherein said engine throttle control means also includes means for releasing and thereby enabling said trigger type throttle mechanism.

23. An assembly in accordance with claim 22 wherein said means for releasing comprises a retaining spring plate set in place on said frame for depressing a trigger safety switch of the saw.

24. An assembly in accordance with claim 23 wherein said retaining spring plate and frame include mutually engageable complementary detent type members for locking the plate in place on the frame.

25. An assembly in accordance with claim 23 and wherein said retaining spring plate includes a spring member located on one side of the plate for engaging the safety switch of the saw.

* * * * *